United States Patent [19]

Blanchard et al.

[11] Patent Number: 4,793,531

[45] Date of Patent: Dec. 27, 1988

[54] WRAPAROUND SKIRT AND SLACK HANGER WITH TENSION ANCHOR

[75] Inventors: Russell O. Blanchard, Zeeland; John H. Batts, Grand Rapids, both of Mich.

[73] Assignee: Batts, Inc., Zeeland, Mich.

[21] Appl. No.: 28,150

[22] Filed: Mar. 26, 1987

[51] Int. Cl.[4] ..... A47G 25/62

[52] U.S. Cl. ..... 223/95; D6/315

[58] Field of Search ..... 223/63, 85, 95, 96, 223/91; D6/315, 326

[56] References Cited

U.S. PATENT DOCUMENTS

| | | | |
|---|---|---|---|
| D. 187,092 | 1/1960 | Charak | 223/95 X |
| 1,843,807 | 2/1932 | Dillon | 223/85 X |
| 2,663,471 | 12/1953 | Pedersen | 223/95 |
| 2,696,936 | 12/1954 | Soldan | 223/95 |
| 2,766,917 | 10/1956 | Jang | 223/95 |
| 2,793,798 | 5/1957 | Simmons | 223/95 |
| 2,908,430 | 10/1959 | Deranja et al. | 223/95 |
| 3,249,270 | 5/1966 | Zuckerman | 223/91 |
| 3,632,028 | 1/1972 | Fussel | 223/95 |
| 4,703,878 | 11/1987 | Louw | 223/95 |

FOREIGN PATENT DOCUMENTS

| | | | |
|---|---|---|---|
| 86/05669 | 10/1986 | World Int. Prop. O. | 223/96 |

*Primary Examiner*—Robert R. Mackey

*Attorney, Agent, or Firm*—Price, Heneveld, Cooper, DeWitt & Litton

[57] ABSTRACT

A hanger for garments of the type having a waistband has a rigid body resistant to compression loads applied lengthwise thereof. The ends of the hanger are so designed that the waistband of a garment can be wrapped around them and then resiliently pulled with sufficient force that the garment seats firmly against the end faces of the hanger body. The hanger has one or more hooks to engage the waistband and a resilient stretchable member to apply tension to the waistband by means of the hook. The end faces of the hanger are so designed that the garment, once tensioned along its waistband, will have no tendency to slide either upwardly or downwardly with respect to the hanger body.

18 Claims, 4 Drawing Sheets

FIG. 1
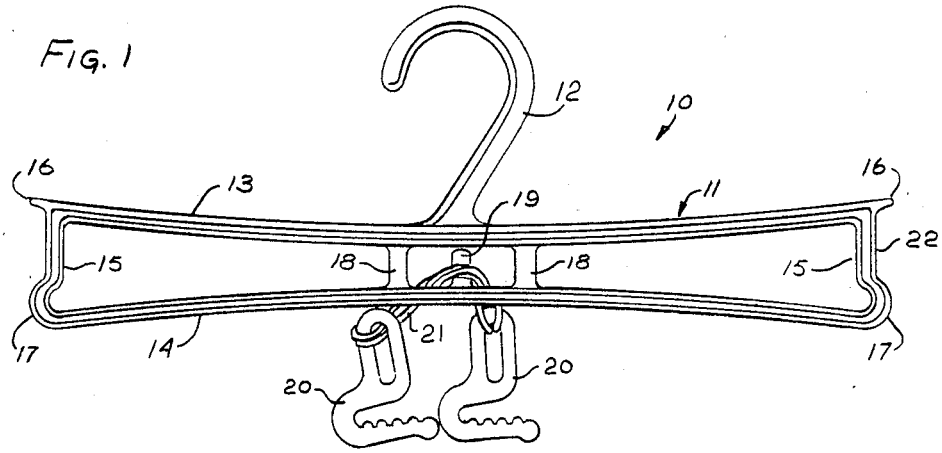
FIG. 2
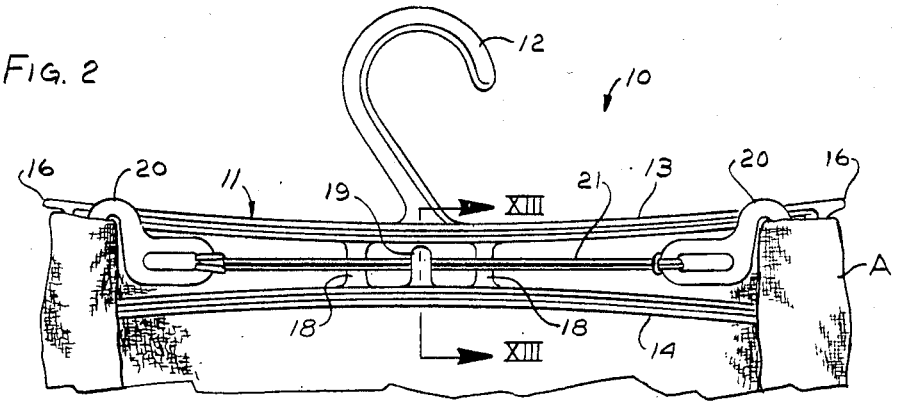
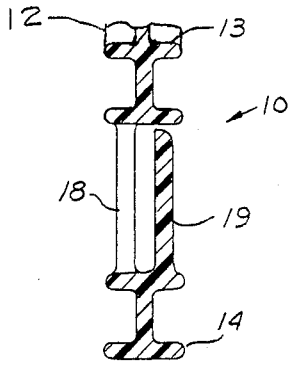
FIG. 13

FIG. 4
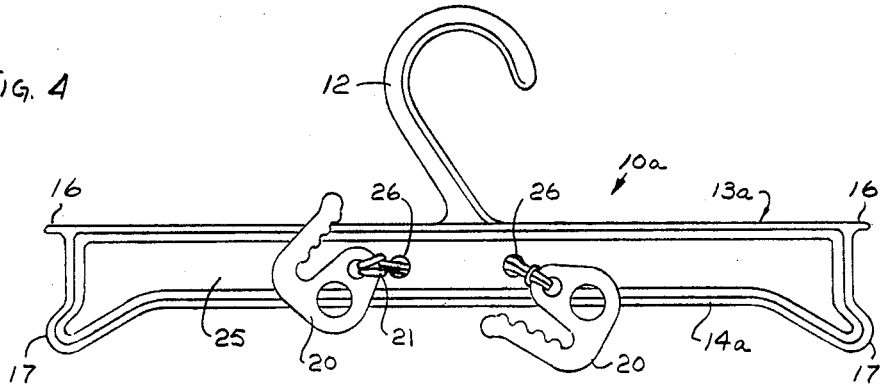
FIG. 5
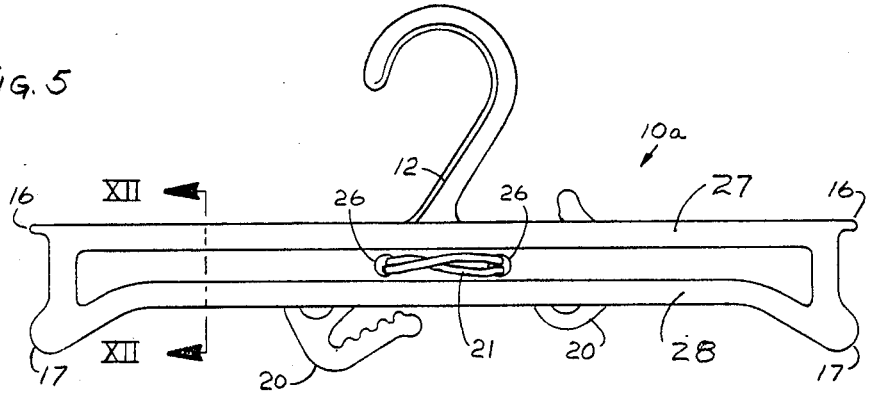
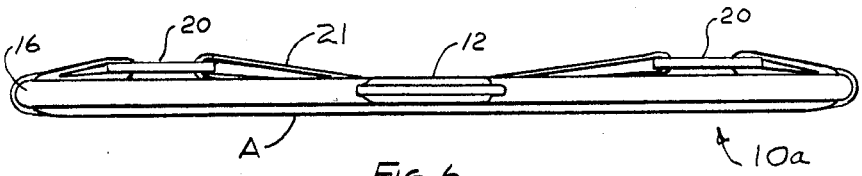
FIG. 6
FIG. 12
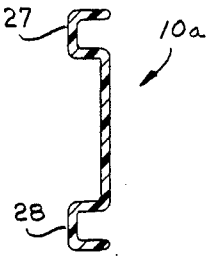
FIG. 3
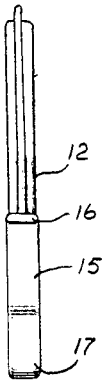

FIG. 10
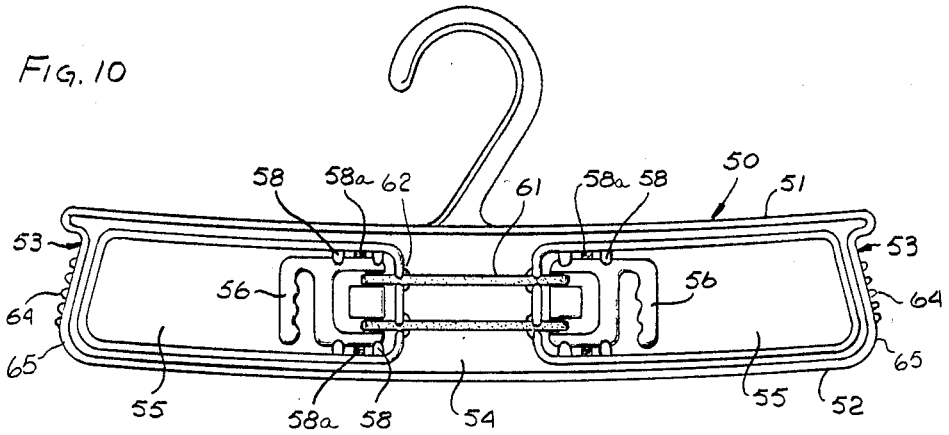
FIG. 11
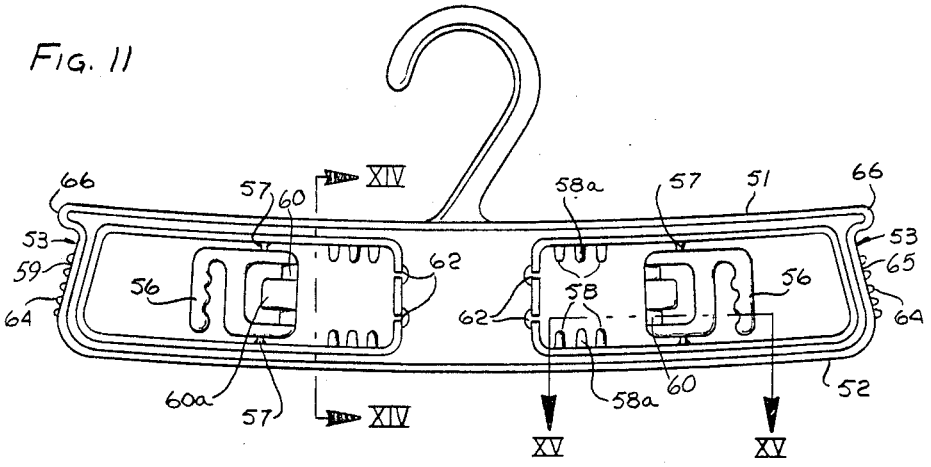
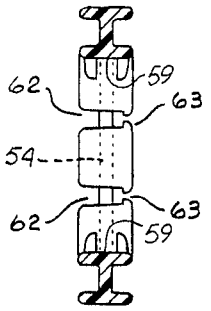
FIG. 14
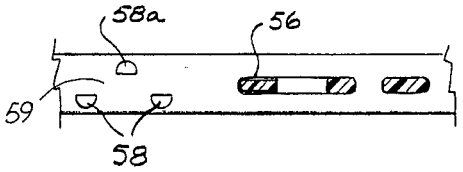
FIG. 15

WRAPAROUND SKIRT AND SLACK HANGER WITH TENSION ANCHOR

FIELD OF THE INVENTION

This invention relates to garment hangers used for either display or shipping of garments having a waistband.

BACKGROUND OF THE INVENTION

The most extensive use of garment hangers today is for shipping and for display of the garments at the point of purchase. Such garment hangers must be capable of positively supporting the garment during shipping and while the garment is being displayed. The hangers must also be so designed that the garments as displayed are attractive and displayed to their best advantage. Also the hanger must not leave any unattractive marks or impressions on the garment.

It is also very important that the hangers add a minimum of bulk to the garment, particularly during shipping. This is also true in many retail facilities where display space is at a premium. Thus, they should be compact and light weight, yet strong enough to support the weight of the garment even during rough handling. The hanger must be easy to use and not require any complex manipulation. In other words, it should be user friendly. It is also important that the cost be held to a minimum because this type of hanger is normally a "one way shipper", that is, it is seldom returned to the garment manufacturer.

It is also true that, as the field of clothes manufacturing and merchandising becomes more competitive, garment hangers are becoming more specialized, that is, suitable for use on only one or on only a few types of garments. This invention provides a hanger of this type, particularly designed for the shipment and display of garments, the tops of which garments are provided with a waistband.

BRIEF DESCRIPTION OF THE INVENTION

The hanger of this invention has a body which is an elongated, rigid beam of molded plastic which beam is supported at the center by a hook which may be molded integrally with the body or, as a separate component, rotatably attached to the body. At each end, the body has a downwardly extending end member over which the waistband of a garment may be hooked or around which the end of the waistband can be wrapped. The hanger is provided with means for applying tension to the waistband of the garment to pull it tightly against the outer face of the end members thereby securing the garment to the hanger. The longitudinally outer face of each end member is so designed that when the waistband is pulled firmly against it, the end face positively holds the garment against release by slipping off the end members.

BRIEF DESCRIPTION OF THE DRAWINGS

FIG. 1 is a front elevation view of a hanger incorporating the invention, before being loaded with a garment;

FIG. 2 is a fragmentary rear elevation view of the hanger illustrated in FIG. 1 after it has been loaded with a garment;

FIG. 3 is an end elevation view of the hanger of FIG. 1 with the hooks omitted;

FIG. 4 is a rear elevation view of a modified form of the hanger illustrated in FIG. 1;

FIG. 5 is a front elevation view of the hanger illustrated in FIG. 4;

FIG. 6 is a top plan view of the hangers illustrated in FIGS. 1–5 after they have been loaded with a garment;

FIG. 10 is an elevation view illustrating a further modified construction for the hanger of this invention;

FIG. 11 is a view similar to FIG. 10 illustrating the hanger as molded;

FIG. 12 is a sectional elevation view taken along the plane XII—XII of FIG. 5;

FIG. 13 is a sectional view taken along the plane XIII—XIII of FIG. 2;

FIG. 14 is a sectional view take along the plane XIV—XIV of FIG. 11; and FIG. 15 is a fragmentary sectional view taken along the plane XV—XV of FIG. 11

DESCRIPTION OF THE PREFERRED EMBODIMENT

Figure 7:
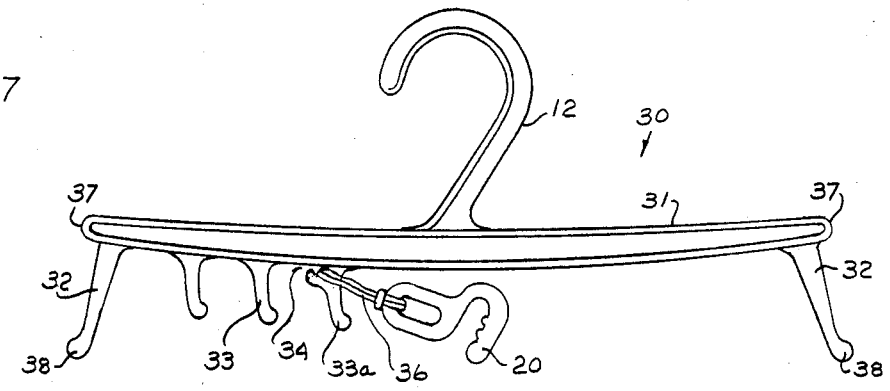
FIG. 7 is a front elevation view of a further modified form of the hanger of this insertion.

Referring to FIG. 1, the numeral 10 indicates a hanger having a body 11 and an integral hook 12. The body has an upper element 13 and a lower element 14. The outer ends of the elements 13 and 14 are joined by generally vertically extending end members 15. The ends of upper element 13 project a short distance beyond the end members 15 to form a pair of stops 16. The lower ends of the end members protrude outwardly to provide positive garment grips 17. Adjacent the center of the hanger, the upper and lower elements are joined by a pair of spaced columns 18. In between the columns 18, an anchor member or finger 19 is provided (FIGS. 1, 2 and 13). The finger 19 is integral with the lower element and extends upwardly but its upper end is spaced from the upper element 13.

The body of the hanger including the upper and lower elements, end members and hook are all molded as a single integral structure from a suitable plastic such as polypropolyene or styrene. As will be seen in FIG. 3, the upper and lower elements and the end members have a thickness such that the body is resistant to compressive forces imposed upon it by the garment and the hereinafter described garment tensioning and anchor means.

The garment anchoring and tensioning means is provided by a pair of hooks 20 joined by a tension creating, resilient, retractable member 21 such as an elastic band. The tension member or band can be of any suitable material, such as rubber, and may be provided by a commercially available rubber band of suitable length and cross section. The stretchable member 21 passes in front of the finger 19 and behind both of the columns 18 (FIG. 2). The gap between the top of the finger 19 and the upper element is so narrow that the elastic member 21 has to be squeezed through it. The finger 19 prevents the assembly of the stretchable member and hooks 20 from becoming separated from the hanger when they are not in use.

FIG. 2 illustrates the hanger in use. One end of the waistband of the garment A is wrapped around one end member of the hanger and secured by one of the hooks 20 which seats around the waistband. The garment is then pulled firmly against the front face of the hanger and wrapped around the other end member of the hanger and secured with the other hook 20 (FIG. 6). In doing this, the member 21 is stretched, thus, tensioning it. This causes the garment to pull firmly against the end faces of the end members 15. Thus, the garment is pulled firmly against the protruding grips 17 and into the shallow recesses 22 between the grips 17 and the stops 16. Thus, the garment is positively held against sliding off the end members even during such conditions as transport from manufacturer to retailer. The garment is well displayed because it is firmly held against the smooth front of the hanger body and the retaining means is hidden behind the garment (FIG. 6).

FIGS. 4 and 5 illustrate a modification of the hanger illustrated in FIGS. 1–3. In this case, the upper and lower elements 13*a* and 14*a* of the hanger 10*a* are joined by a solid web 25 provided with a pair of spaced opening 26 adjacent the center of the hanger. The stretchable member 21 passes through these openings from front to back and on the back is secured to a hook 20 at each end. The hanger 10*a* functions in exactly the same way as hanger 10. The body of this hanger has upper and lower C-shaped rails 27 and 28 which provide rigidity and compression resistance for the body (FIG. 12).

Figure 8:
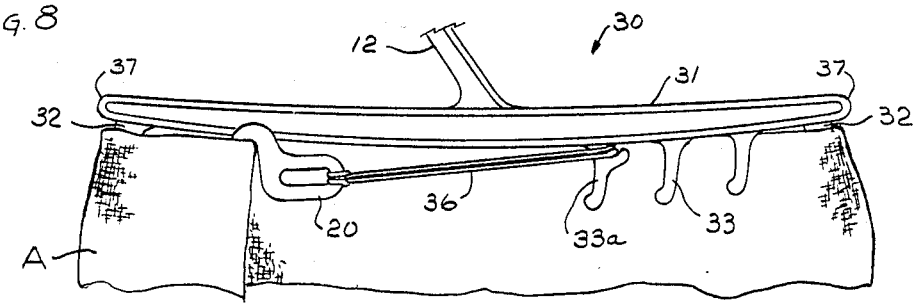
FIG. 8 is a fragmentary rear elevation view of the hanger of FIG. 7 loaded with a garment.
Figure 9:
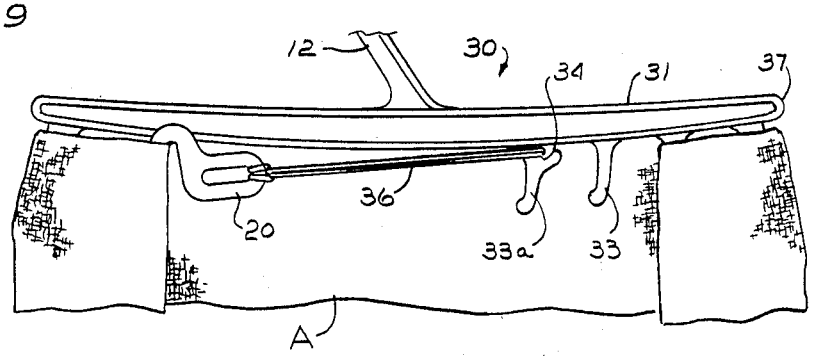
FIG. 9 is a view similar to FIG. 8 but illustrating a modified way of securing the garment.

FIGS. 7–9 illustrate a modified construction for the hangers of this invention. In this construction, the hanger 30 is provided with only one hook 20. The body of the hanger consists of a rigid I-beam 31 having an outwardly and downwardly inclined end finger or member 32 at each end. Adjacent one end of the hanger, one or more dependent fingers 33 are provided. The fingers 33 are integral with body beam 31 and are inclined oppositely to the adjacent end member, that is, they are inclined downwardly and inwardly. The innermost one 33*a* of the fingers has an outwardly opening notch 34 adjacent the finger's attachment to the beam 31. The hook 35 is secured to the body by a stretchable member 36 which is anchored to the inner finger 33*a* by means of the notch 34. The ends of the beam 31 extend beyond the end members 32 to form stops 37 which serve the same purpose as the stops 16. The end members 32 are inclined outwardly and downwardly and terminate in an outwardly extending, smoothly rounded, garment grip 38.

Among the ways in which this hanger can be used, two are illustrated in FIGS. 8 and 9. In FIG. 8, the end member 32 at one end is seated inside the waistband and the garment then pulled smoothly across the front of the hanger and wrapped around the other end member and pulled firmly against both end members by the hook tensioned by the stretchable member 36. This arrangement is particularly useful with garments having a small waistline.

FIG. 9 illustrates the operation of the hanger with a larger waistband. Depending upon the length of the waistband, the end of the garment which was secured to the first end member is now wrapped around it and hooked over one of the fingers 33. The other end of the waistband is wrapped about the opposite end member and then secured by means of the hook. Thus, a hanger of a single size and construction will satisfy a wide range of garment sizes.

FIGS. 10 and 11 illustrate a still further modification of this invention. In this construction, preferably, the body and the hooks are molded simultaneously. The body 50 has upper and lower elements 51 and 52 joined at the ends by end members 53 and in the center by a panel 54. Between the ends of the panel 54 and the end members 53, the body has front to back openings 55. As molded, the hooks 56 are formed simultaneously with the body 50 and joined to the body by rupturable gates or connectors 57 (FIG. 11) through which the liquid plastic flows from the body into the hook cavities, during the injection molding process. After the molding process is completed, the connectors 57 are broken or cut, freeing the hooks.

Also molded into the body are guide fingers 58 and 58*a*. The guide fingers are arranged such that no two are aligned front to back, thus, eliminating interference with opening the mold. They are spaced apart the thickness of the hooks in a fore and aft direction and, thus, form guideways or channels 59 (FIGS. 14 and 15) at the top and bottom of the openings along which the hooks can slide and be stored when not in use. This is possible because the upper and lower elements 51 and 52 are of I-beam cross section with the hooks having a wall thickness equal to that of the web 54.

Each of the hooks has an end bar 60 from which a tab 60*a* extends outwardly. After the hooks have been separated from the body of the hanger, they are joined by an endless stretchable member 61 which is secured by being seated over the tabs of the hooks. Between the hooks, the stretchable member 61 passes through openings 62 in the beam flange (FIGS. 10 and 14). The openings each have a restricted throat 63 requiring the stretchable member 61 to be forcibly compressed when it is first assembled to the body 50. This arrangement secures the hooks to the body when they are not in use. However, except for the restricted throat, the openings are of a size to permit the stretchable to freely slide through them whereby that portion of the member between the openings is free to flex and contribute to the tension applied by the hooks.

The end members have a plurality of shallow, rounded teeth 64 extending down the outer face 65. These provide a means for gripping the garment. The outer face 65 is inclined downwardly and outwardly and because of the teeth 64 does not have the protruding grip structure with which the other versions of this invention are equipped. With any of the hangers which have been described, it is a matter of choice whether one uses the protruding type grip or the teeth or even both for particularly bulky and heavy garments.

The end of the upper element 51 extends beyond the end member to form a stop 66 similar to the stops 16 and 37. In each case, the stop prevents the garment under the tension applied by the stretchable member on the upward and inward inclination of the end face from tending to work its way up the hanger ends, thus, burying the hanger further and further into the garment where it no longer engages the waistband. This particularly could this be a problem when the garment is being shown to a customer and for some reason is laid flat on a surface.

In all cases, the hanger can be injection molded by simple two piece molds without slides or other complicating equipment. The hangers are light weight and utilize only minimal quantities of plastic to form a strong and effective means of transporting and displaying garments. In every case, the upper and lower elements, in order to provide the necessary resistance to compression have either an I-beam or a T-type cross section. This is essential because the hanger, while relatively thin, must not flex by bowing forwardly or rearwardly under the tension applied through the hooks. Any such bowing would tend to release of the garment. It will be recognized that hangers of this type may have to be molded with different degrees of plastic wall thickness and, thus, rigidity dependent upon the size and weight of the garment with which it is to be used. However, each hanger can be used for a wide range of sizes and weights and it is only in connection with the very lightest and the very heaviest garments that consideration has to be given to this problem.

Having described a preferred embodiment of this invention together with several modifications of it, it will be recognized that other modifications can be made without departing from the principles of the invention. Such modifications are to be considered as included in the hereinafter appended claims, unless these claims, by their language, expressly state otherwise.

We claim:

1. A garment hanger having a rigid body formed as a single straight elongated beam of fixed length, hook means for supporting said body, said body having a depending member at each end, said members each having an outwardly facing garment engaging end surface shaped to extend downwardly and outwardly to resist sliding movement relative thereto of a garment pulled firmly around both of said members to press the garment against said end surfaces; a pair of hooks each one adapted to engage an opposite end of a garment, the top of which garment extends along one face of the body and the ends thereof are wrapped around said members to seat against the opposite face of said body, tension means connecting said hooks and resiliently urging said hooks toward each other and the center of the body for applying equal tension to both ends of the garment and hold it against said end surfaces with said garment being substantially centered about the midpoint of the body between said end surfaces.

2. A garment hanger having a body, said body having vertically spaced upper and lower rigid compression resistant beam elements joined at each end by generally vertically extending end elements; hook means for supporting said body, the end faces of said end elements being shaped to resist sliding movement of a garment lengthwise of said end elements; support means forming part of said body and centered between said end elements and integral with said upper and lower beam elements, a pair of hooks; a resilient stretchable element joining said hooks to each other, anchor means for securing said stretchable element to said body substantially midway between said end elements, said stretchable element normally holding said hooks in retracted position adjacent said anchor means, each of said hooks adapted to engage an adjacent end of a garment, the top of which garment extends along one face of the body and the ends thereof are wrapped around said end elements to seat against the opposite face of said body, whereby said stretchable element is stretched for applying tension to the garment to pull the ends thereof toward each other and the center of the hanger and hold it against the outwardly directed faces of said end elements.

3. A garment hanger as described in claim 2, wherein said support means is a panel.

4. A garment hanger as described in claim 3 wherein said stretchable element is an endless loop and said means for securing said stretchable element to said panel are pocket-like openings in the ends of said panel, each having an entry access of a size requiring deformation of said stretchable element for passage therethrough.

5. A garment hanger as described in claim 3 wherein said hooks are each flat panel-like members and are molded of a synthetic plastic material simultaneously with said hooks lying in the same plane as said body; rupturable connecting means joining each of said hooks to said panel as molded.

6. A garment hanger as described in claim 2, wherein each of said hooks has a tab extending in the longitudinal direction of said body and said stretchable element is an endless loop the ends of which are seated over said tabs for securing said hooks to said stretchable member.

7. A garment hanger as described in claim 2 wherein both of said upper and lower beam elements have a plurality of ears, said ears of each beam element projecting toward the ears on the other thereof, said ears on each beam element being arranged to form to channel therebetween of a width to receive for sliding movement one of said hooks for storage thereof.

8. A garment hanger having upper and lower beam elements forming an elongated body of fixed length, hook means for supporting said body, said body having a depending end member at each end, said end members each having an outwardly facing garment engaging end surface shaped to resist sliding movement relative thereto of a garment pulled firmly around said end members to press the garment against said end surfaces; a pair of hooks each one adapted to engage an opposite end of a garment the top of which extends along one face of the body and the ends thereof are wrapped around said end members to seat against the opposite face of said body, an elongated resilient tension member resiliently urging said hooks toward each other and away from said end members for applying tension to the garment necessary to hold it against said surfaces of said end members; a pair of longitudinally spaced web elements joining said upper and lower beam elements, a vertically extending finger intermediate said web elements; the upper end of said finger being spaced from said upper beam element to create a passage through which said tension member can be passed whereby said tension member can be seated over said finger and between said finger and said web elements to prevent unintentional disassociation of said hooks from said body.

9. A garment hanger having an elongated body having upper and lower elements, hook means for supporting said body, said body having a depending member at each end, said members each having an outwardly facing garment engaging end surface shaped to resist sliding movement relative thereto of a garment pulled firmly around said members to press the garment against said end surfaces; a pair of hooks each one adapted to engage an opposite end of a garment, the top of which extends along one face of the body and the ends thereof are wrapped around said members to seat against the opposite face of said body, an elongated tension member resiliently urging said hooks toward each other for applying tension to the garment and hold it against said end surfaces; said upper and lower elements being joined by a pair of longitudinally spaced web elements, a vertically extending finger intermediate said web elements; the upper end of said finger being spaced from said upper element to create a passage through which said tension means can be passed whereby said tension means can be seated over said finger to prevent unintentional disassociation of said hooks from said body.

10. A garment hanger having a straight elongated rigid beam-like body of fixed length capable of withstanding longitudinal compressive pressure, said body having generally flat front and rear faces and a depending end member at each end, said members each having an outwardly facing garment engaging end surface shaped to resist downward sliding movement of a garment pulled firmly against said hanger's rear face and around said end members to press the garment against said end surfaces; said body and end members all being arranged in a single plane; a pair of hooks moveable along the rear of said body toward and away from each other and resilient stretchable means securing said hooks to each other and to said body substantially at the midpoint between said end members and urging them toward each other and the center of said body; each of said hooks being adapted to engage a different end of the waistband of a garment, the front and back portions of which waistband are seated against the front face of said body and wrapped around both of said end members and said stretchable means in stretched condition urging said hooks toward each other and causing the garment to seat firmly against both said front and rear faces and pull firmly against both of said end surfaces of said end members with the resilient means equalizing the degree of tension applied to the opposite ends of the garment.

11. A garment hanger as described in claim 10 wherein said resilient stretchable means is an elongated resilient member secured to both hooks.

12. A garment hanger as described in claim 11 wherein said body has vertically spaced upper and lower elements joined at the ends by said depending end members; a web element intermediate said end members for joining said upper and lower elements; a pair of front to back openings defined by said web element through both of which said resilient stretchable means passes whereby said resilient stretchable means is secured to said body.

13. A garment hanger as described in claim 11 wherein said body is a panel of rectangular cross section of substantially greater vertical height than thickness; a pair of front to back openings in said panel adjacent the longitudinal center of said panel through both of which said resilient stretchable means passes whereby said resilient stretchable means is secured to said body.

14. A garment hanger as described in claim 11 wherein said body is an elongated beam, a pair of fingers depending from said body intermediate the ends thereof and on opposite sides of the longitudinal center of said body; each of said fingers having an upwardly and outwardly opening notch in the edge thereof facing the adjacent end of the body; a pair of hooks each having one end of said resilient means seated in one of said notches for securing it to said body to hold the hook in garment clamping position at the end of said body opposite from that which the notch faces.

15. A garment hanger as described in claim 10 wherein said resilient stretchable means is a strand of rubber-like material.

16. A garment hanger as described in claim 10 wherein said end surfaces have outwardly projecting teeth.

17. A garment hanger as described in claim 10 wherein said end surfaces are inclined outwardly and downwardly.

18. A garment hanger as described in claim 10 wherein said end surfaces each have an outwardly protruding portion at their lower ends.

* * * * *

UNITED STATES PATENT AND TRADEMARK OFFICE

CERTIFICATE OF CORRECTION

PATENT NO. : 4,793,531

DATED : December 27, 1988

INVENTOR(S) : Russell O. Blanchard et al.

It is certified that error appears in the above-identified patent and that said Letters Patent is hereby corrected as shown below:

Column 3, lines 19 and 20:
"opening" should be --openings--
Column 4, line 34:
After "stretchable" insert --member--
Column 4, line 56:
After "could" delete --this--
Column 5, line 2
After "release" delete --of--

Signed and Sealed this

Seventeenth Day of October, 1989

*Attest:*

DONALD J. QUIGG

*Attesting Officer*

*Commissioner of Patents and Trademarks*